US009827579B2

(12) United States Patent
Hidaka et al.

(10) Patent No.: US 9,827,579 B2
(45) Date of Patent: Nov. 28, 2017

(54) HOT MELT ADHESIVE APPLICATION METHOD AND HOT MELT ADHESIVE APPLICATION DEVICE

(71) Applicant: SUN TOOL CORPORATION, Morigushi-shi, Osaka (JP)

(72) Inventors: Shoji Hidaka, Osaka (JP); Shinichi Okahira, Osaka (JP)

(73) Assignee: Sun Tool Corporation, Moriguchi-shi (JP)

( * ) Notice: Subject to any disclaimer, the term of this patent is extended or adjusted under 35 U.S.C. 154(b) by 0 days.

(21) Appl. No.: 14/772,960

(22) PCT Filed: Dec. 16, 2013

(86) PCT No.: PCT/JP2013/085331

§ 371 (c)(1),
(2) Date: Jan. 4, 2016

(87) PCT Pub. No.: WO2014/136367

PCT Pub. Date: Sep. 12, 2014

(65) Prior Publication Data

US 2016/0151794 A1 Jun. 2, 2016

(30) Foreign Application Priority Data

Mar. 7, 2013 (JP) ..... 2013-067370
Apr. 9, 2013 (JP) ..... 2013-094584

(51) Int. Cl.
*B05B 1/24* (2006.01)
*B05B 7/08* (2006.01)
(Continued)

(52) U.S. Cl.
CPC ..... *B05B 1/24* (2013.01); *B05B 7/0815* (2013.01); *B05B 7/0861* (2013.01); *B05C 5/025* (2013.01); *B05D 5/10* (2013.01)

(58) Field of Classification Search
CPC ..... B05B 1/24; B05B 7/0815; B05B 7/0861; B05C 5/025
(Continued)

(56) References Cited

U.S. PATENT DOCUMENTS 4,031,854 A * 6/1977 Sprague, Jr. ..... A43D 25/18 118/302
4,098,632 A * 7/1978 Sprague, Jr. ..... A43D 25/183 12/142 F
(Continued)

FOREIGN PATENT DOCUMENTS

JP 5-309310 A 11/1993
JP 6-254446 A 9/1994
(Continued)

*Primary Examiner* — Chee-Chong Lee
(74) *Attorney, Agent, or Firm* — Norton Rose Fulbright US LLP

(57) ABSTRACT

In front view of the application nozzle, all of the pressurized air flow K and adhesive flow H are made to run parallel to each other in the vertical direction.

Of the pressurized air flows K from the pressurized air hole b in the pressurized air plate, the two that are located on one side of the adhesive hole opening a and from a pair in the front-to-back direction are tilted so as to approach each other.

The extension lines thereof are located on the side of the adhesive bead, which results from the adhesive flow discharged from the adhesive hole opening, and have directions that converge.

The respective pressurized air flows on the two side of the adhesive bead are made to flow downward while uniting in the direction of convergence.

A web in which the adhesive bead is elongated while being swung in the transverse direction is formed and, near the bottom surface of the application nozzle, a non-interference space Q is formed between the adhesive bead and the fore pressurized air flow.

(Continued)

The adhesive bead, resulting from the adhesive flow discharged from the adhesive hole opening, and the pressurized air flows do not interfere with each other and walls R of pressurized air flows are formed below the non-interference space Q and on either side of the adhesive bead.

1 Claim, 10 Drawing Sheets

(51) Int. Cl.
*B05C 5/02* (2006.01)
*B05D 5/10* (2006.01)

(58) Field of Classification Search
USPC ..... 239/418
See application file for complete search history.

(56) References Cited

U.S. PATENT DOCUMENTS 4,135,903 A * 1/1979 Ohsato ..... D01D 5/26 264/12
4,185,981 A * 1/1980 Ohsato ..... D01D 5/0985 264/12
7,255,292 B2 * 8/2007 Saidman ..... B05B 7/0861 239/290

FOREIGN PATENT DOCUMENTS

JP 8-243461 A 9/1996
JP 10-183454 A 7/1998
JP P2004-195434 A 7/2004

* cited by examiner

HOT MELT ADHESIVE APPLICATION METHOD AND HOT MELT ADHESIVE APPLICATION DEVICE

CROSS REFERENCE TO RELATED APPLICATIONS

This application is a national stage of international application no. PCT/JP2013/085331 filed on Dec. 16, 2013, and claims the benefit of priorities under 35 USC 119 of Japanese application nos. 2013-067370 and 2013-094584, filed on Mar. 7, 2013 and Sep. 4, 2013, respectively, which are incorporated herein by reference.

TECHNICAL FIELD

The invention of the present application relates to a hot-melt adhesive application method and a hot-melt adhesive application device for forming an adhesive applied face on an upper face of a substrate on a traveling application line while forming fibrous beads of hot-melt adhesive by causing pressurized air from pressurized air holes to act on the hot-melt adhesive beads from hot-melt adhesive holes.

BACKGROUND ART

With regard to the hot-melt adhesive application method for applying adhesive in a predetermined pattern on an upper face of a substrate on a traveling application line while forming fibrous beads of hot-melt adhesive by causing pressurized air from pressurized air holes to act on the hot-melt adhesive beads from hot-melt adhesive holes, the following inventions are known.

Patent Document 1: "Application Nozzle Device in Curtain Fiber-Like Spray Application Device" in Unexamined Japanese Patent Publication No. H08-243461 (Japanese Patent No. 3661019), which is the invention by the applicant of the present application Patent Document 2: "Melt-Blowing Method and Device" in Unexamined Japanese Patent Publication No. H10-183454 (Japanese Patent No. 4008547)

Patent Document 3: "Hot-Melt Adhesive Application Device" in Unexamined Japanese Patent Publication No. H05-309310, which is the invention by the applicant of the present application Patent Document 4: "Application Nozzle Device in Curtain Fiber-Like Spray Application Device" in Unexamined Japanese Patent Publication No. H06-254446, which is the invention by the applicant of the present application Patent Document 5: "Applied Object of Stitch-Like Pattern, Application Method of Viscous Fluid Material, Application Device, and Nozzle" in Unexamined Japanese Patent Publication No. 2004-195434

In the invention in Patent Document 1, filamentous adhesive beads, which are formed by stretching adhesive beads by causing pressurized air to act on adhesive beads discharged from adhesive holes, are continuously applied in continuous circular patterns on a surface of a substrate.

In the invention in Patent Document 2, second fluid outlets are positioned on opposite sides of a first fluid outlet and the first fluid outlet and the second fluid outlets are arranged in a straight line so that a fiber or a fluid filament is formed by melt blowing. By positioning second fluid (pressurized gas, pressurized air) on opposite sides of first fluid (hot-melt adhesive bead), the hot-melt fiber or the hot-melt filament formed by melt blowing is swung leftward and rightward.

In each of the invention in Patent Document 3 and the invention in Patent Document 4, a hot-melt fiber is formed by a melt blowing operation by causing pressurized air from pressurized air holes to act on an adhesive bead discharged from an adhesive hole so that an applied face of hot-melt adhesive in a form of a non-woven fabric is formed on a substrate. The hot-melt fiber is fine and torn and scattered to the surroundings, which degrades a work environment.

In the invention in Patent Document 5, by causing flows of pressurized air to collide with adhesive beads discharged from adhesive holes, an applied face having a stitch-like pattern is formed on a substrate face.

DISCLOSURE OF THE INVENTION

In each of the inventions in Patent Documents 1 through 5 because the hot-melt fiber or the hot-melt adhesive filament (web) is formed by the melt blowing operation caused by collision or contact of the second fluid (pressurized gas, pressurized air) with the first fluid (hot-melt adhesive bead), there are problems of degradation of the work environment and waste of a large amount of second fluid (pressurized air or the like) due to the scatter of the hot-melt adhesive fiber to the surroundings by a spray effect caused by the contact of the second fluid (pressurized air or the like) with the first fluid (hot-melt adhesive bead).

Objects of the invention of the present application are to prevent the scatter of the hot-melt fibers to the surrounding environment and reduction in an amount of consumption of the second fluid (pressurized air or the like) in the above-described known inventions.

And the object is provided an applied face Hc on the surface of the substrate formed by the adhesive webs Hb are distributed substantially uniformly throughout the application width.

According to the first aspect of the present invention, there is provided a hot-melt adhesive application method by the hot-melt adhesive application device, in which a large number of adhesive holes and a large number of pressurized air holes are formed in a bottom face of a nozzle in lines orthogonal to a traveling direction of an application line, a non-interference space Q is formed between the adhesive bead and the four pressurized airflows, where the adhesive bead formed by the adhesive flow discharged from the adhesive hole opening and the pressurized airflows do not interfere with each other, and wherein pressurized airflows K exist on opposite sides of each of adhesive flows H and all of the pressurized airflows K and the adhesive flows H are in a vertical direction and arranged side by side in a front view of an application nozzle, wherein pressurized airflows K exist on opposite sides of each of adhesive flows H and all of the pressurized airflows K and the adhesive flows H are in a vertical direction and arranged side by side in a front view of an application nozzle, two of the pressurized air hole flows K, which are from pressurized air holes b in pressurized air plates and which are disposed at front and back positions beside each of the adhesive hole openings a and paired up with each other, are inclined to approach each other, so that extended lines of the pressurized airflows K are positioned beside an adhesive bead formed by the adhesive flow discharged from the adhesive hole opening, and oriented to converge, the respective pressurized airflows on each side of the adhesive bead flow down while being integrated with each other in a converging direction so that in a P zone, a web swinging in a lateral direction is formed while the adhesive bead is stretched and that a second non-interference space QA continuous with a non-interference space Q is formed between the adhesive bead and the four pressurized airflows, where the adhesive bead formed by the adhesive flow discharged from the adhesive hole opening and the pressurized airflows do not interfere with each other, and said second non-interference space QA and said walls R of the pressurized airflows are formed on opposite sides of the adhesive bead.

According to second aspect of the present invention, in addition to the first aspect, there is provided the hot-melt adhesive application method, wherein pressurized air is discharged from pressurized air holes formed as fine and straight holes, so that straight traveling performance of the pressurized airflows is increased and that the pressurized airflows facing each other converge at a lower position, to expand the second non-interference space QA and reduce an area affected by melt blow due to contact between the hot-melt adhesive bead and the pressurized air to reduce an amount of consumption of the pressurized air and prevent and reduce scatter of the hot-melt adhesive to a work environment.

According to the third aspect of the present invention, there is provided a hot-melt adhesive application device, in which a large number of adhesive holes and a large number of pressurized air holes are formed in a bottom face of a nozzle in lines orthogonal to a traveling direction of an application line, a set of four pressurized air hole openings b in total is paired up with a single adhesive hole opening by positioning the pressurized air hole openings b of pressurized air plates 3 in directions of diagonal lines with respect to each of the adhesive hole openings a and positioning the pressurized air hole openings b in the respective pressurized air plates substantially in extended directions of the diagonal lines with respect to each of the adhesive hole openings a, and a non-interference space Q is formed on left, right, front, and back sides of an adhesive bead between the adhesive bead and pressurized airflows, where the adhesive bead and the pressurized airflows do not interfere with each other near the bottom face of the application nozzle, wherein the pressurized air holes exist on opposite sides of each of the adhesive holes and all of the pressurized air holes and the adhesive holes are in vertical directions and arranged side by side in a front view of the application nozzle, and two of the pressurized air holes b of the pressurized air plates, which are disposed at front and back positions beside the adhesive hole opening a and paired up with each other, are inclined to approach each other, so that extended lines of the two pressurized air holes b are positioned on a side of the adhesive bead discharged from the adhesive hole opening, and oriented to converge.

According to the invention of the present application, the non-interference space Q where the pressurized airflows do not come in contact with the adhesive flow is formed between the bottom face of the nozzle and the P zone where the pressurized airflows come in contact with the adhesive bead and an adhesive filament is formed by melt blowing. Therefore, by avoiding contact between the adhesive bead and the pressurized air and restricting an area affected by the spray effect by the pressurized air, it is possible to reduce flow rates of the pressurized airflows to reduce a necessary amount of energy for the pressurized air and it is possible to reduce scatter of the adhesive to the work environment.

Furthermore, by forming the band-shaped walls R formed by the pressurized air on the left and right sides of the adhesive bead at a lower position of the non-interference space Q, a scattering area is restricted in a left-right direction (direction orthogonal to a transfer direction of a substrate) when the adhesive bead discharged from the adhesive hole opening a is formed into the hot-melt adhesive fibrous bead by the effect of the pressurized air and flows down while swinging in the left-right direction.

Amounts of consumption of the pressurized air and the hot-melt adhesive are reduced and the scatter of the hot-melt adhesive fibers formed by the melt blowing operation to the work environment can be prevented.

When the webs (hot-melt adhesive filaments) are formed, because of the walls R of the pressurized air on the opposite sides of each of the webs (hot-melt adhesive filaments), the webs (hot-melt adhesive filaments) Hb swing in the left-right direction and land on the substrate while being entangled with each other in the left-right direction. Therefore, the webs (hot-melt adhesive filaments) Hb can be distributed substantially uniformly on the surface of the substrate and the hot-melt applied face on the surface of the substrate can be formed in a uniform applied pattern by the lateral swinging.

BEST MODES FOR CARRYING OUT THE INVENTION

The invention of the present application will be described with reference to FIG. 1 and FIG. 2.

Figure 1:
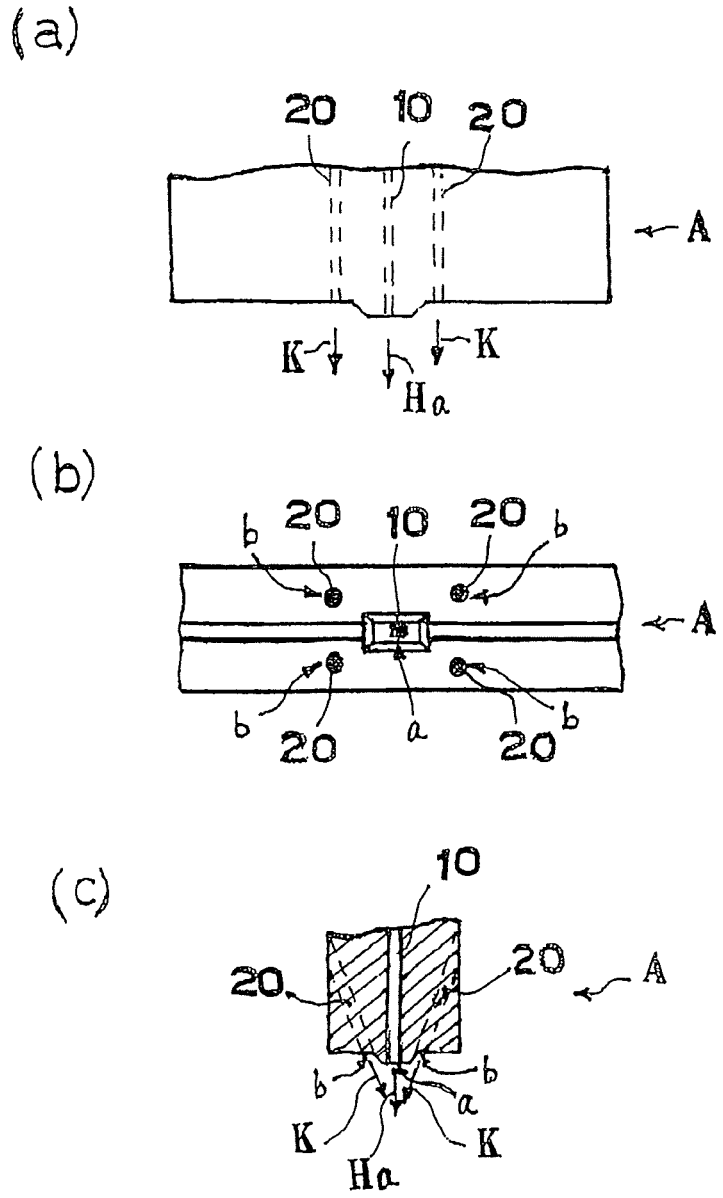
FIG. 1 shows the invention of application nozzle device and show positional relationships between an adhesive hole opening a and a set of four pressurized air hole openings b paired up with each other, wherein FIG. 1(*a*) is a front view, FIG. 1(*b*) is a bottom view, and FIG. 1(*c*) is a side view.

FIG. 1 schematically shows an application nozzle device and show positional relationships between an adhesive hole opening a and a set of four pressurized air hole openings b paired up with each other, wherein FIG. 1(*a*) is a front view, FIG. 1(*b*) is a bottom view, and FIG. 1(*c*) is a side view.

With reference to FIG. 1(*a*), in a front view of an application nozzle, all of pressurized airflows K and an adhesive flow H are in a vertical direction and arranged side by side.

With reference to FIG. 1(*b*), in a bottom view of the application nozzle, the pressurized airflows K are discharged from respective corner portions of a rectangle having the adhesive hole opening a at its center and the single adhesive flow H is paired up with the set of four pressurized air hole flows K in total.

With reference to FIG. 1(*c*), two of the pressurized airflows K, which are from the pressurized air holes b in a pressurized air plate and which are disposed at front and back positions beside the adhesive hole opening a and paired up with each other, are inclined to approach each other, so that their extended lines are positioned beside an adhesive bead formed by the adhesive flow discharged from the adhesive hole opening, and oriented to converge.

Figure 2:
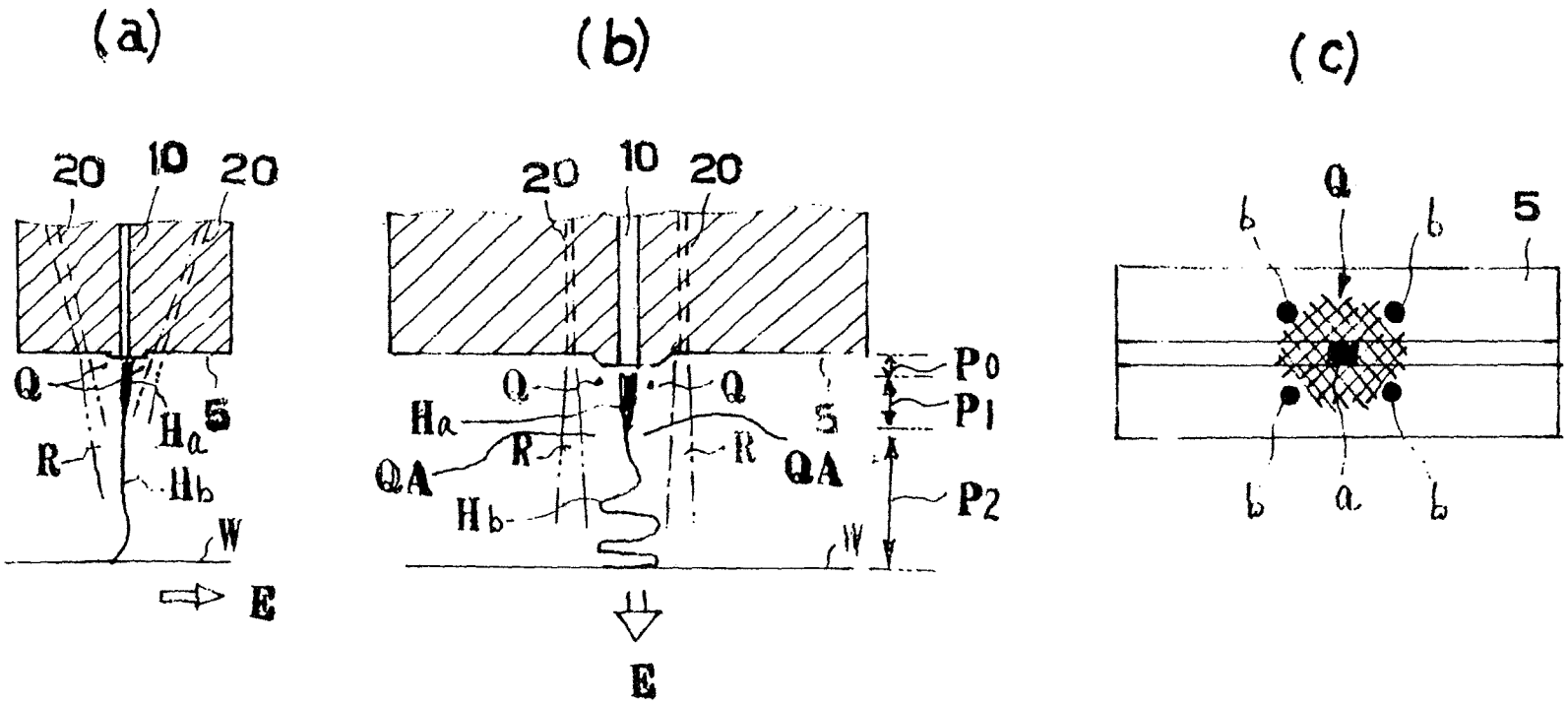
FIG. 2 shows the second non-interference space QA and the walls R and are explanatory views of the operation of the invention of the present application, wherein FIG. 2(*a*) is a front vertical sectional view at a sectional position of the adhesive hole and FIG. 2(*b*) is a side vertical sectional view at a sectional position of the adhesive hole.
Figure 3:
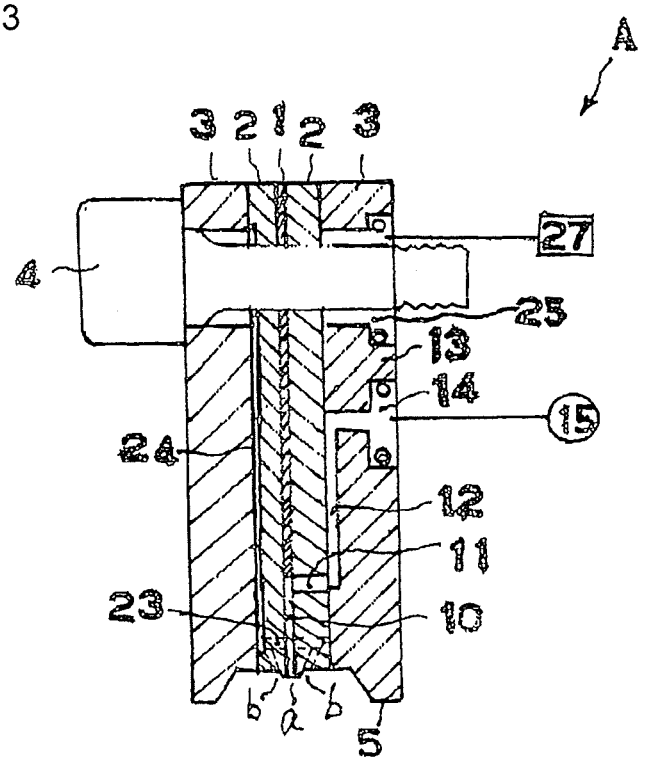
FIG. 3 is a vertical sectional view schematically showing an application nozzle device according to a first embodiment of the invention of the present application.
Figure 4:
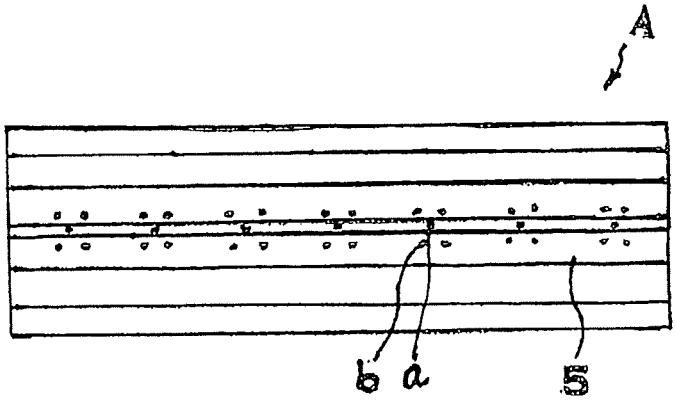
FIG. 4 is a bottom view schematically showing the same application nozzle device and showing positional relationships between adhesive hole openings a and sets of four pressurized air hole openings b respectively paired up with each other.

With reference to FIG. 2, in a PO zone near the bottom face of the application nozzle, the respective pressurized airflows on each side of the adhesive bead flow down while being integrated with each other in the converging direction so that the non-interference spaces Q are formed between the adhesive bead and the four pressurized airflows and that the adhesive bead and the four pressurized airflows do not interfere with each other near the bottom face of the application nozzle.

In a P1 zone slightly lower than a P0 zone near the bottom face of the application nozzle and, as a result, the adhesive hole bead Ha is stretched into a web (adhesive bead) Hb, formed between the adhesive bead and the four pressurized airflows, where the adhesive bead formed by the adhesive flow discharged from the adhesive hole opening and the pressurized airflows do not interfere with each other, and in a P2 zone in which formed the adhesive bead, following p1, forming a web swinging in a lateral direction, and the band-shaped walls R of the pressurized airflows are formed on opposite sides of the adhesive bead.

When the fibrous bead Ha comes in contact with the band-shaped walls R formed by the converging flow of pressurized air K and is affected by the pressurized air K, the adhesive hole bead Ha is stretched into the web (adhesive bead) Hb.

By the band-shaped walls R, when the fibrous bead Ha comes in contact with the band-shaped walls R formed by the converging flow of pressurized air K and is affected by the pressurized air K, the adhesive hole bead Ha is stretched into the web (adhesive bead) Hb, and the adhesive webs Hb are distributed substantially uniformly throughout the application width, and lands on the surface of the traveling substrate.

By forming the second non-interference space QA to reducing interference between the pressurized airflows and the adhesive bead, forming of adhesive fiber is avoided and scatter of adhesive to the outside of a specified area of the application substrate and the scatter of the adhesive to the work environment are substantially prevented while it is possible to reduce a fed amount of the pressurized air to thereby reduce energy for feeding the pressurized air.

In the second aspect of the invention, in the above-described invention, pressurized air is discharged from pressurized air holes formed as fine and straight holes so that straight traveling performance of the pressurized airflows is increased and that the pressurized airflows facing each other converge at a lower position.

In the embodiment, by forming each of the pressurized air holes 20 as the fine and straight hole having a sectional area of about 0.1 $mm^2$, it is possible to give the straight traveling performance to the pressurized airflows K to substantially completely eliminate scatter at the pressurized air hole openings b to thereby improve directionality of the pressurized airflows K.

Examples of a sectional shape of each of the pressurized air holes 20 are as follows:

a circle of ϕ0.3 and a sectional area of 0.07 $mm^2$;

a circle of ϕ0.35 and a sectional area of 0.09 $mm^2$;

a circle of ϕ0.4 and a sectional area of 0.12 $mm^2$;

a square of 0.3×0.3 and a sectional area of 0.09 $mm^2$;

a rectangle of 0.2×0.5 and a sectional area of 0.1 $mm^2$; and a rectangle of 0.3×0.4 and a sectional area of 0.12 $mm^2$.

The hot-melt adhesive application device according to the invention of the present application will be described below based on embodiments shown in the accompanying drawings.

First Embodiment

Figure 5:
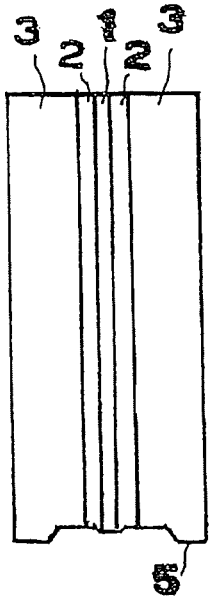
FIG. 5 is a side view schematically showing the same application nozzle device.
Figure 6:
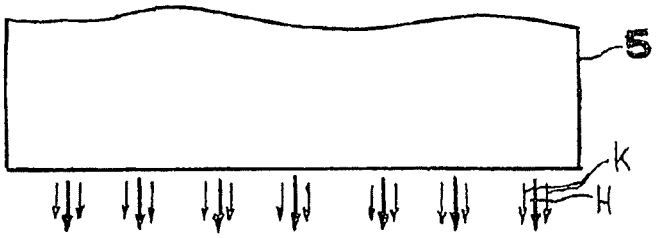
FIG. 6 is a front view schematically showing the same application nozzle device.
Figure 7:
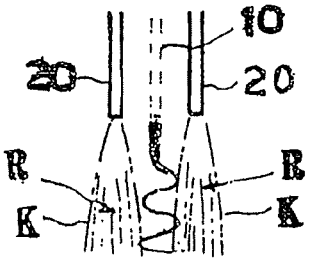
FIG. 7 is a vertical sectional view in a longitudinal direction of the application nozzle device and showing positional relationships between an adhesive bead from the adhesive hole opening a and pressurized air from the pressurized air hole openings b.

With reference to FIGS. 5 to 7, an application nozzle device A is formed by disposing pressurized air plates 2, 2 and cover plates 3, 3 on front and back opposite sides of an adhesive plate 1 in a traveling direction of an application line.

The plates 3, 2, 1, 2, and 3 are fixed and integrated with each other by fastening members 4, 4A.

Each of adhesive holes 10 communicates with an adhesive feed port 14 through communication paths 11, 12, and 13 and communicates with a hot-melt feed source 15.

Left and right pressurized air holes 20 are integrated with each other through a communication path 23 and communicate with a pressurized air feed port 26 through communication paths 24 and 25.

Pressurized air is fed from a pressurized air feed source 27 to the pressurized air feed port 26.

The large number of adhesive holes 10 are formed in the adhesive plate 1 to form a large number of adhesive hole openings a in a bottom face of a nozzle in a line orthogonal to the traveling direction of the application line and a large number of pressurized air holes 20 are formed in each of the pressurized air plates 2 to form a large number of pressurized air hole openings b in the bottom face of the nozzle in a line orthogonal to the traveling direction of the application line.

By positioning the pressurized air hole openings b of the pressurized air plates 3 in directions of diagonal lines with respect to each of the adhesive hole openings a and positioning the pressurized air hole openings b in the respective pressurized air plates substantially in extended directions of the diagonal lines with respect to each of the adhesive hole openings a, the set of four pressurized air hole openings b in total is paired up with the single adhesive hole opening.

Figure 8:
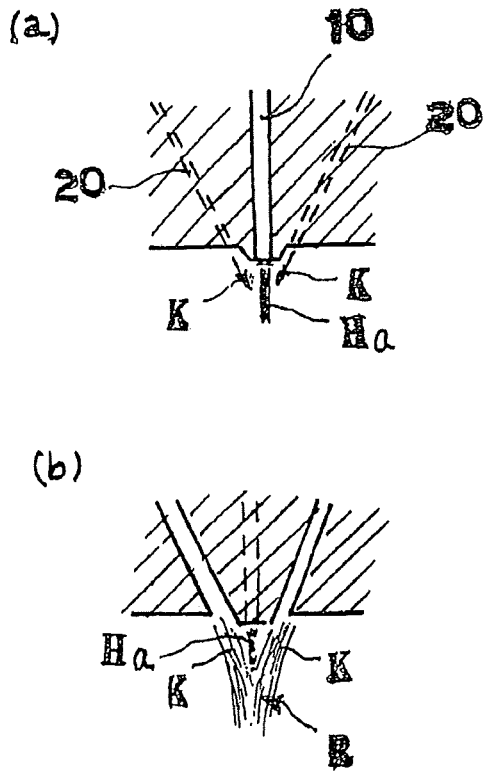
FIG. 8 is vertical sectional views in a transverse direction of the same application nozzle device, wherein FIG. 8(*a*) is a view at a sectional position of the adhesive hole opening and FIG. 8(*b*) is a view at a sectional position of the pressurized air holes.

In front views of the application nozzle shown in FIG. 8 all of the pressurized air holes 20 and the adhesive hole 10 are in vertical directions and arranged side by side.

With reference to FIGS. 8(*a*) and 8(*b*), two of the pressurized air holes 20 of the pressurized air plates, which are disposed at front and back positions beside the adhesive hole opening a and paired up with each other, are inclined to approach each other, so that their extended lines are positioned on sides of a lower end portion of an adhesive bead Hb, formed by adhesive discharged from the adhesive hole opening, and oriented to converge.

In the embodiment, each of the adhesive holes 10 is formed by a space between a skewer-shaped groove formed in a lower portion of the adhesive plate 1 and inner faces of the pressurized air plates 2 and has a square section of 0.3 mm×0.3 mm.

A pressurized air chamber 21 is formed on a side of each of the pressurized air plates 2, and the pressurized air hole 20 is formed by a through hole having a circular section and passing straight between the pressurized air chamber 21 and a bottom face. The pressurized air hole 20 has a circular section of about 0.3 mm and a sectional area of about 0.09 $mm^2$.

The two pressurized air holes 20 paired up with each other are respectively inclined about 30° in an opposed direction of the holes 20 and are provided at an interval of 60°.

Because the pressurized air hole 20 is inclined, the pressurized air hole opening b of the pressurized air hole 20 has a shape of an ellipse with a longer axis in a transverse direction of the bottom face.

A guide ridge is formed on a side of the bottom face of each of the pressurized air plates 2 close to the adhesive plate 1 to extend the adhesive hole 10 so that the adhesive hole opening a protrudes farther than the pressurized air hole openings b.

With reference to FIG. 7 and FIG. 8, an adhesive bead Ha discharged from the adhesive hole opening a and is affected by the pressurized air K in near the bottom face of the application nozzle.

When the fibrous bead Ha comes in contact with the band-shaped walls R formed by the converging flow of pressurized air K and is affected by the pressurized air K, the adhesive hole bead Ha is stretched into the web (adhesive bead) Hb, drops while swinging leftward and rightward with its left-right swinging width restricted by the pressurized air K adjacent to the web Hb, and lands on the surface of the traveling substrate.

Figure 9:
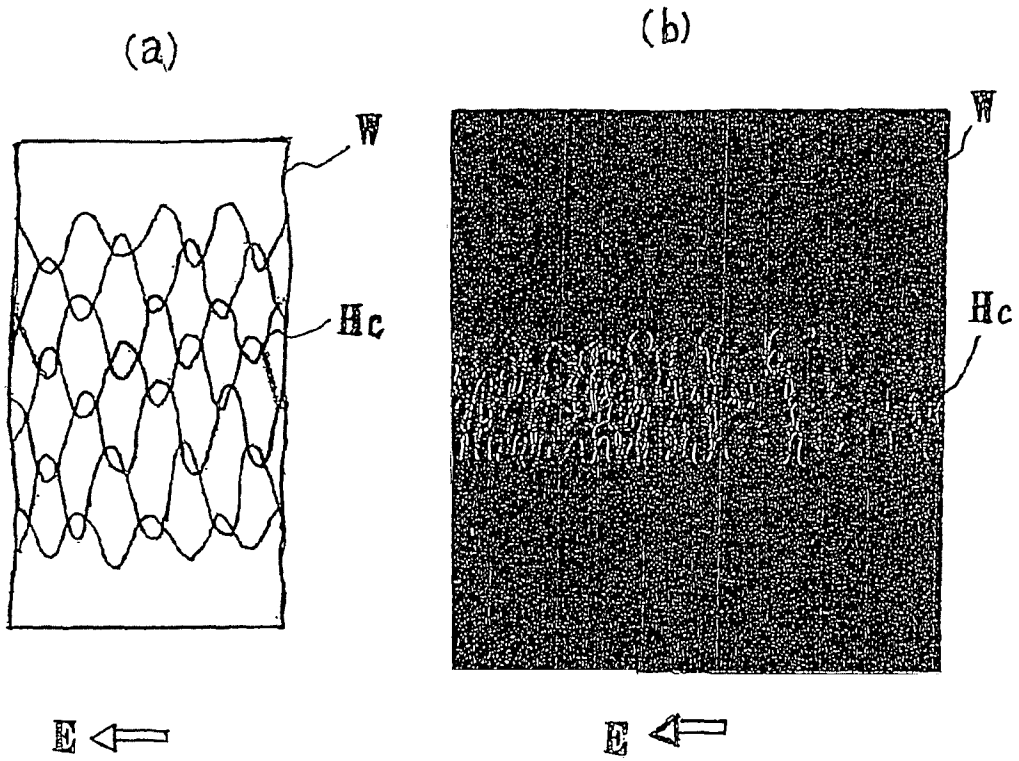
FIG. 9 is explanatory views of an applied film on an application line.

With reference to FIG. 9, an applied face Hc on the surface of the substrate formed by the adhesive webs Hb is restricted to a predetermined application width (25 mm, in the embodiment), the entire application width is restricted to the predetermined application width (25 mm, in the embodiment), and the adhesive webs Hb are distributed substantially uniformly throughout the application width. In the applied face Hc in FIG. 9(*a*), continuous curves are entangled with each other. In the applied face Hc in FIG. 9(*b*), the fibrous beads are formed with an infinite number of broken curves entangled with each other. In each of FIGS. 9(*a*) and 9(*b*), an arrow E shows a transfer direction of a substrate W.

In the above-described embodiment, by reducing the size of sections of the pressurized air holes 20, it is possible to reduce energy required by the pressurized air source to ⅓ to ⅕ of that in the conventional device.

Second Embodiment

Figure 10:
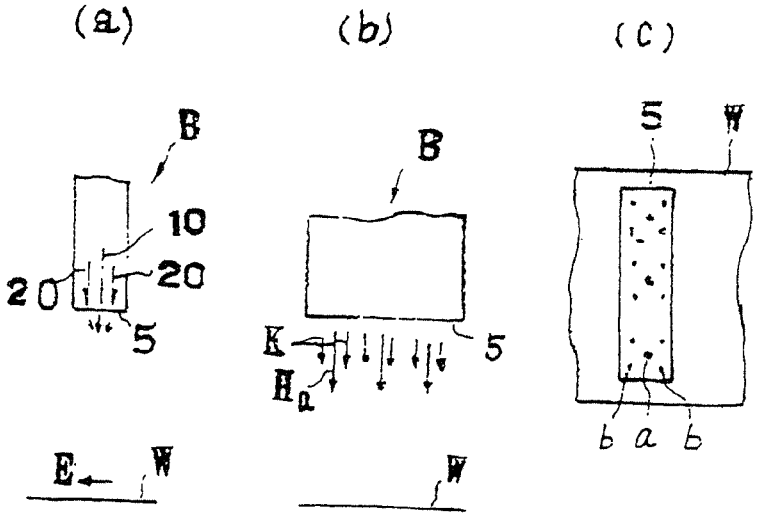
FIG. 10 schematically shows an application nozzle device according to a second embodiment of the invention of the present application, wherein FIG. 10(*a*) is a side vertical sectional view, FIG. 10(*b*) is a front view, and FIG. 10(*c*) is a bottom view.
Figure 11:
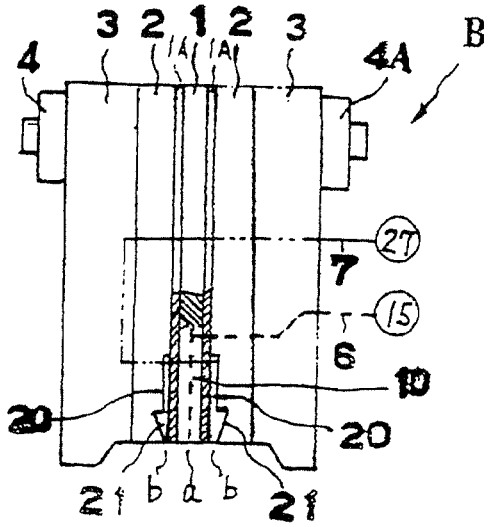
FIG. 11 is a partially-sectional side view of the same application nozzle device.
Figure 12:
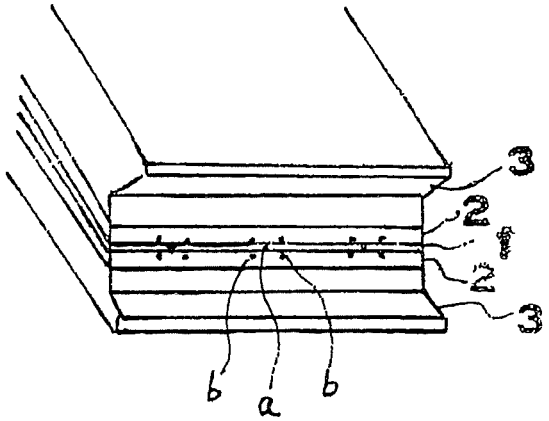
FIG. 12 is a bottom perspective view of the same application nozzle device and showing positional relationships between adhesive hole openings a and sets of four pressurized air hole openings b respectively paired up with each other.
Figure 13:
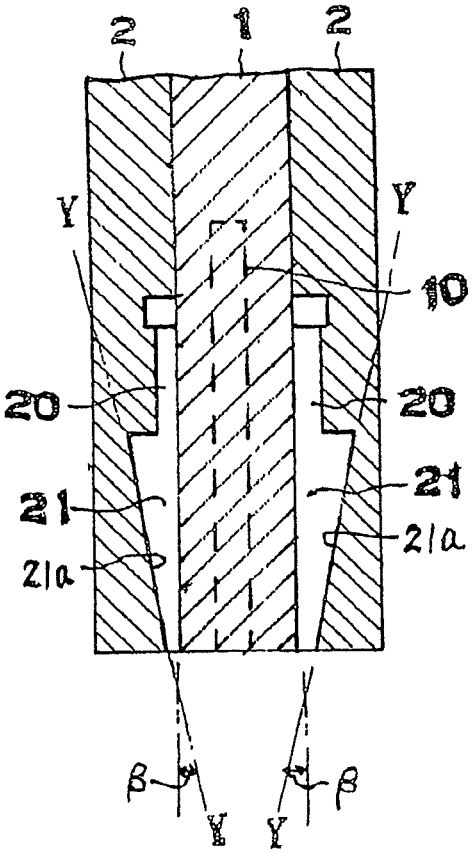
FIG. 13 is a vertical sectional view in a transverse direction of the same application nozzle device and is a view at a sectional position of the pressurized air holes.

With reference to FIG. 10 to FIG. 12, an application nozzle device A is formed by disposing pressurized air plates 2, 2 and cover plates 3, 3 on front and back opposite sides of an adhesive plate 1 in a traveling direction of an application line with adhesive plate 1 at a center.

The plates 3, 2, 1, 2, and 3 are fixed and integrated with each other by fastening members 4, 4A.

Each of adhesive holes 10 communicates with an adhesive feed port 14 through communication paths 11, 12, and 13 and communicates with a hot-melt feed source 15.

Left and right pressurized air holes 20 are integrated with each other through a communication path 23 and communicate with a pressurized air feed port 26 through communication paths 24 and 25.

Pressurized air is fed from a pressurized air feed source 27 to the pressurized air feed port 26.

The large number of adhesive holes 10 are formed in the adhesive plate 1 to form a large number of adhesive hole openings a in a bottom face of a nozzle in a line orthogonal to the traveling direction of the application line and a large number of pressurized air holes 20 are formed in each of the pressurized air plates 2 to form a large number of pressurized air hole openings b in the bottom face of the nozzle in a line orthogonal to the traveling direction of the application line.

By positioning the pressurized air hole openings b of the pressurized air plates 3 in directions of diagonal lines with respect to each of the adhesive hole openings a and positioning the pressurized air hole openings b in the respective pressurized air plates substantially in extended directions of the diagonal lines with respect to each of the adhesive hole openings a, a set of four pressurized air hole openings b in total is paired up with the single adhesive hole opening.

In a front view of the application nozzle shown in FIG. 10(*b*), all of the pressurized air holes 20 and the adhesive holes 10 are in a vertical direction and arranged side by side. With reference to FIGS. 10(*a*) and 15(*a*) to 15(*c*), two of the pressurized air holes 20 of the pressurized air plates, which are disposed at front and back positions beside the adhesive hole opening a and paired up with each other, are inclined to approach each other, so that their extended lines are positioned on a side of an adhesive bead discharged from the adhesive hole opening, and oriented to converge.

In the embodiment, each of the adhesive holes 10 is formed by a space between a skewer-shaped groove formed in a lower portion of the adhesive plate 1 and inner faces of the pressurized air plates 2 and has a square section of 0.3 mm×0.3 mm.

A pressurized air chamber 21 is formed on a side of each of the pressurized air plates 2 and a pressurized air hole 20 is formed by a through hole having a circular section and passing straight between the pressurized air chamber 21 and a bottom face. The pressurized air hole 20 has a circular section of about 0.3 mm and a sectional area of about 0.09 $mm^2$.

The two pressurized air holes 20 paired up with each other are respectively inclined about 30° in an opposed direction of the holes 20 and are provided at an interval of 60°.

A guide ridge is formed on a side of the bottom face of each of the pressurized air plates 2 close to the adhesive plate 1 to extend the adhesive hole 10 so that the adhesive hole opening a protrudes farther than the pressurized air hole openings b.

In the second embodiment, similarly to the first embodiment, the paired front and back converging flows of pressurized air K are adjacent to each of left and right sides of the adhesive bead Ha.

The adhesive bead Ha is affected by the band-shaped walls formed by the paired converging flows of the pressurized air K and, as a result, stretched into a web Hb. The web Hb swings leftward and rightward with its left-right swinging width restricted by the band-shaped walls adjacent to the web Hb, and the adjacent webs Hb drop while being entangled with each other and land on the surface of the traveling substrate.

With reference to FIG. 9, the applied face Hc on the surface of the substrate formed by the webs Hb is restricted to a predetermined application width (25 mm in the embodiment), the entire application width is restricted to the predetermined application width (25 mm in the embodiment), and the webs Hb are distributed substantially uniformly throughout the application width. In the applied face Hc in FIG. 9(*a*), continuous curves are entangled with each other. In the applied face Hc in FIG. 9(*b*), filament beat are formed as an infinite number of broken curves entangled with each other. In each of FIGS. 9(*a*) and 9(*b*), arrow E shows a transfer direction of the substrate W.

In the above-described embodiment, by reducing the size of sections of the pressurized air holes 20, it is possible to reduce energy required by the pressurized air source to ⅓ to ⅕ of that in the conventional device similarly to the first embodiment.

Figure 14:
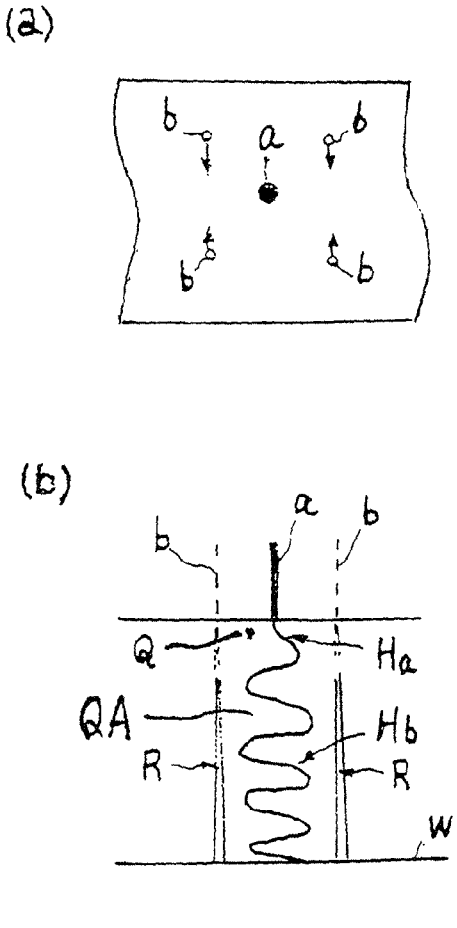
FIG. 14 are simplified diagrams for explaining the operation of the second aspect of the invention of the present application, wherein FIG. 14(*a*) is a bottom view of a nozzle, FIG. 14(*b*) is a front view of the nozzle, and FIG. 14(*c*) shows an applied face on a substrate face.

In the second aspect of the invention in the present application, with reference to FIGS. 14(*a*) to 15(*c*), non-interference spaces Q are expanded downward and an interval between the left and right opposed walls R of the pressurized air near the applied face on the substrate is widened by improving straight traveling performance of the pressurized air, and the hot-melt applied face on the surface of the substrate can be formed as the applied face formed by only the hot-melt adhesive fibrous beads (webs) by reducing application of the hot-melt fiber face (Hd).

Figure 15:
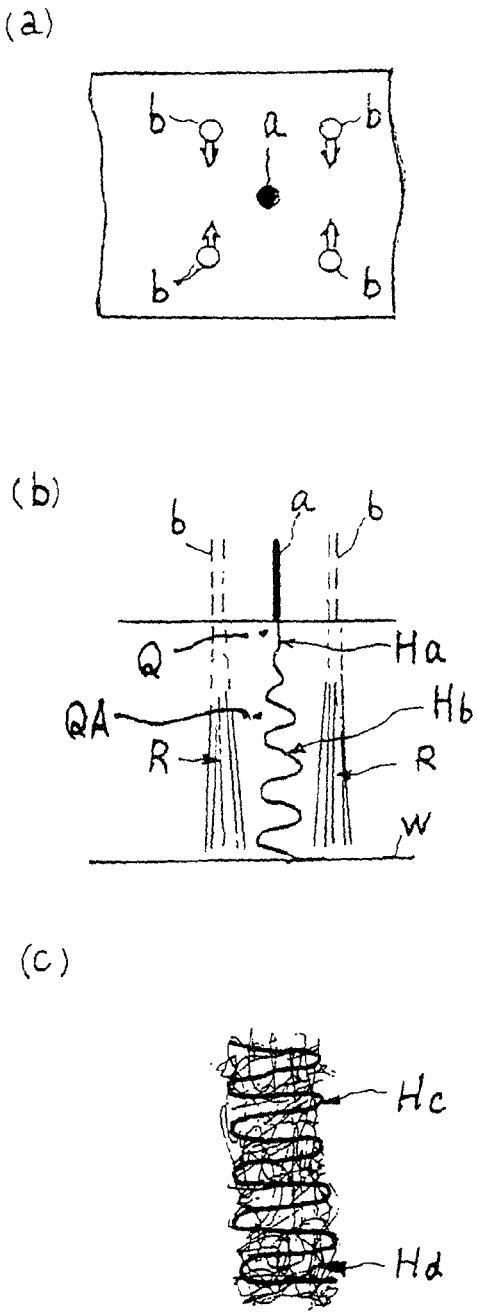
FIG. 15 is are simplified diagrams for explaining the same when a fibrous applied face also exists by a melt blowing operation.
Figure 16:
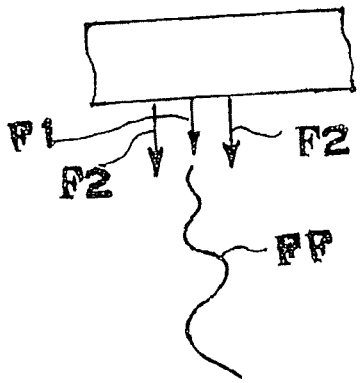
FIG. 16 is an explanatory view of a first flow F1 and second flows F2 in a known technique shown in Document 2.
Figure 17:
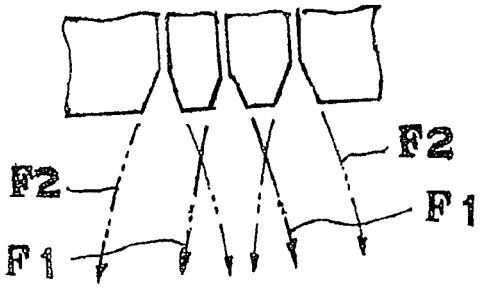
FIG. 17 is a vertical sectional view schematically showing an application nozzle device in the same.

Moreover, by changing and selecting the straight traveling performance of the pressurized air, it is possible to select the applied state in FIG. 9(*a*) or 9(*b*), the applied face (see FIG. 14) of only the hot-melt adhesive fibrous beads (webs) or the mixture (see FIG. 15) of the hot-melt adhesive fibrous beads (webs) and the hot-melt adhesive fibers, and increase or decrease of the hot-melt adhesive fibers mixed in the hot-melt adhesive fibrous beads (webs) with regard to the hot-melt applied face on the surface of the substrate.

It is possible to select a form of the applied face Hc according to a form of the surface of the substrate (e.g., a difference between a smooth surface (polyethylene sheet) and a rough surface (non-woven fabric)).

INDUSTRIAL APPLICABILITY

The invention of the present application contributes to improvement in manufacturing cost by reducing a used amount of the hot-melt adhesive and reducing the fed amount of the pressurized air in forming an applied layer of the hot-melt adhesive on the substrate by the hot-melt adhesive application device.

The invention claimed is:

1. A hot-melt adhesive application method comprising:

providing a hot-melt adhesive application device having a nozzle, in which a large number of adhesive holes and a large number of pressurized air holes are formed in a bottom flat face of the nozzle in lines orthogonal to a traveling direction of an application line, and are formed in a repeating pattern of a central adhesive hole surrounded by four pressurized air holes at corners of a rectangle, the four pressurized air holes comprising a front right air hole, a front left air hole, a rear right air hole, and a rear left air hole, discharging pressurized airflows from the four pressurized air holes, discharging an adhesive flow from the central adhesive hole to form an adhesive bead, forming a first non-interference space between the bottom flat face of the nozzle and the adhesive bead in which the pressurized airflows do not interfere with each other, wherein the pressurized airflows discharged from the front right air hole and front left air hole exist on opposite sides of the adhesive flow in a vertical direction in a front view of the nozzle, the pressurized airflows discharged from the front right air hole and the rear right air hole are inclined to approach each other, and the pressurized airflows discharged from the front left air hole and the rear left air hole are inclined to approach each other, so that the pressurized airflows flow down and converge on left and right sides of the adhesive bead, a second non-interference space continuous with the first non-interference space is formed between the adhesive bead and the pressurized airflows on the left and right sides of the adhesive bead, and as the adhesive bead drops and contacts the converging pressurized airflows on the left and right sides of the adhesive bead below the second non-interference space, the adhesive bead swings in a lateral direction and is stretched into a web.

* * * * *